US007845504B2

(12) United States Patent
Davenport et al.

(10) Patent No.: US 7,845,504 B2
(45) Date of Patent: Dec. 7, 2010

(54) SYSTEM AND METHOD FOR DETERMINING WHETHER A LOCOMOTIVE OR RAIL ENGINE IS COUPLED TO A RAIL CAR OR OTHER ENGINE

(75) Inventors: David Michael Davenport, Niskayuna, NY (US); Rahul Bhotika, Niskayuna, NY (US); John Erik Hershey, Ballston Lake, NY (US); Robert James Mitchell, Waterford, NY (US); Emad Andarawis Andarawis, Ballston Lake, NY (US); Kenneth Brakeley Welles, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 1242 days.

(21) Appl. No.: 11/317,067

(22) Filed: Dec. 23, 2005

(65) Prior Publication Data

US 2007/0145196 A1 Jun. 28, 2007

(51) Int. Cl.
*B61G 5/06* (2006.01)

(52) U.S. Cl. ..... 213/1.3; 246/1 C

(58) Field of Classification Search ..... 246/1 R, 246/1 C, 167 R; 213/75 R, 77, 100 R, 109, 213/1.3, 1.6

See application file for complete search history.

(56) References Cited

U.S. PATENT DOCUMENTS

| | | | | |
|---|---|---|---|---|
| 4,520,662 A | | 6/1985 | Schmid | 79/129 |
| 4,838,173 A | | 6/1989 | Schroeder et al. | 105/35 |
| 4,892,204 A | * | 1/1990 | Lumbis | 213/1.6 |
| 5,586,669 A | * | 12/1996 | Seay et al. | 213/43 |
| 5,735,491 A | | 4/1998 | Atkinson | 246/124 |
| 5,950,967 A | | 9/1999 | Montgomery | 246/182 |
| 6,206,215 B1 | * | 3/2001 | Maa | 213/75 R |
| 7,177,732 B2 | * | 2/2007 | Kraeling et al. | 701/19 |
| 7,195,267 B1 | * | 3/2007 | Thompson | 280/477 |
| 2003/0182030 A1 | | 9/2003 | Kraeling et al. | 701/19 |
| 2005/0062590 A1 | * | 3/2005 | Lang et al. | 340/431 |

FOREIGN PATENT DOCUMENTS

DE 3112322 A1 10/1982

OTHER PUBLICATIONS

Letter from Liu, Shen & Associates dated Apr. 26, 2010.

* cited by examiner

*Primary Examiner*—S. Joseph Morano
*Assistant Examiner*—Robert J McCarry, Jr.
(74) *Attorney, Agent, or Firm*—Marie-Claire Maple

(57) ABSTRACT

An apparatus and method for indicating whether a coupler of a locomotive is in a coupled or uncoupled state is provided. The apparatus comprising: a sensor positioned on a portion of the coupler, wherein the sensor provides a real-time signal indicative of either a coupled or an uncoupled state of a coupler, wherein the signal is transmitted wirelessly by a transmitter in operable communication with the sensor. The method comprising: providing a signal indicative of the presence or proximity of a second coupler to the first coupler, the signal being provided by a sensor configured to provide the signal as the state of the coupler has changed; transmitting the signal wirelessly to a controller; processing the signal with a control algorithm resident upon the controller; and providing visually perceivable indication of the position of the coupler.

11 Claims, 5 Drawing Sheets

SYSTEM AND METHOD FOR DETERMINING WHETHER A LOCOMOTIVE OR RAIL ENGINE IS COUPLED TO A RAIL CAR OR OTHER ENGINE

BACKGROUND

This invention relates generally to rail yards, and more particularly to methods and apparatus for determining whether a train engine is coupled to a rail car.

Rail yards are the hubs of railroad transportation systems. Therefore, rail yards perform many services, for example, freight origination, interchange and termination, locomotive storage and maintenance, assembly and inspection of new trains, servicing of trains running through the facility, inspection and maintenance of railcars, and railcar storage. The various services in a rail yard compete for resources such as personnel, equipment, and space in various facilities so that managing the entire rail yard efficiently is a complex operation.

The railroads in general recognize that yard management tasks would benefit from the use of management tools based on optimization principles. Such tools use a current yard status and a list of tasks to be accomplished to determine an optimum order in which to accomplish these tasks.

However, any management system relies on credible and timely data concerning the present state of the system under management. In most rail yards, the current data entry technology is a mixture of manual and automated methods. For example, automated equipment identification (AEI) readers and AEI computers determine the location of rolling stock at points in the sequence of operations, but in general, this information limits knowledge of rolling stock whereabouts to at most, the moment at which the rolling stock arrived, the moment at which the rolling stock passes the AEI reader, and the moment at which the rolling stock departs.

The location of assets within a rail yard is typically reported using voice radio communications. Point detection approaches such as wheel counters, track circuits, and automatic equipment identification (AEI) tag readers have been used to detect assets at specific, discrete locations on the tracks. Modern remote control systems use GPS and AEI tags to prevent the remote-controlled locomotive from traveling outside the yard limits. Cameras have been deployed throughout rail yards with shared displays to allow rail yard personnel (i.e. yard masters, hump masters, manager of terminal operations) to locate engines and other assets.

In particular, rail yard operators couple and uncouple rail cars as they enter, leave and traverse through the rail yard. These rail cars are coupled and uncoupled to train engines including locomotive engines and yard engines. For example, operators can uncouple rail cars from inbound locomotive engines and couple rail cars to outbound locomotive engines. Further, yard engines can be coupled to rail cars in order to transport the rail cars to appropriate locations within the rail yard for loading, unloading, or other processing.

Train engines in the rail yard can be tracked to determine the progress of a task being performed, as well as to determine whether the train engine(s) is/are being utilized efficiently. In order to track engines at a rail yard, an operator can monitor the coupling and decoupling of locomotive engines and yard engines wherein information about the train status is provided via radio communications. However, an operator-monitored system can be inefficient in that it does not result in real time monitoring of the train engine's status as such communication, if present, may be exchanged well after the coupling or uncoupling event has occurred.

For efficient rail yard operations it would be useful to have an automatic system, which monitors the status of the yard engines and provides real time data. In particular, real time data indicating whether an engine is coupled or decoupled from a rail car will provide insight as to the progress of rail yard operations. In addition, rail yards may have many yard engines actively working to process inbound trains and to build outbound trains.

Therefore, yard operational efficiency may be realized by the ability to automatically verify that an engine is coupled to and moving one or more rail cars. Further benefits may be realized by using yard engine operational status in yard planning tasks. With automated, real-time knowledge as to operation of yard engines, the yard operation team will be able to assess available and utilized resources to plan subsequent tasks accordingly.

Accordingly, it is desirable to provide an apparatus and system for indicating whether train engines are coupled or decoupled from rail cars, wherein real time data is provided from an automatic monitoring system.

SUMMARY OF THE INVENTION

An apparatus for indicating whether a first coupler of a locomotive is in a coupled or uncoupled state. The apparatus comprising: a sensor positioned on a portion of the first coupler, wherein the sensor provides a real-time signal indicative of either the presence or proximity of a second coupler within a receiving area of the first coupler, wherein the signal is transmitted wirelessly by a transmitter in operable communication with the sensor.

A coupler configured to indicate whether the coupler has been coupled to another rail car is also provided. The coupler comprising: a main body portion comprising, a neck portion and a receiving area defined by a portion of the main body portion; a knuckle pivotally mounted to the main body portion and configured for movement between a coupled position and an uncoupled position wherein the knuckle pivots into the receiving area as the knuckle pivots from the uncoupled position to the coupled position; and a sensor positioned on a portion of the coupler, wherein the sensor provides a signal indicative of either a coupled state or an uncoupled state of the coupler, the coupled or uncoupled state being defined by the presence of a second coupler within the receiving area of the first coupler, wherein the signal is transmitted wirelessly by a transmitter in operable communication with the sensor.

A system for detecting whether a coupler of a locomotive has been coupled to another rail car is also provided. The system comprising: a sensing device configured to provide a signal indicative of a coupling state of the coupler; a transmitter in operable communication with the sensor, the transmitter being configured to receive and transmit the signal; a status detection system configured to receive the signal from the transmitter, the status detection system comprising; and a controller, a storage medium; and a display device, wherein the controller is configured to provide a graphical indication of the coupler position on the display device, wherein the graphical indication provides real time status of locomotive.

In another exemplary embodiment, a method for determining whether a coupler of a locomotive engine is in either a coupled or uncoupled state is also provided. The method comprising: providing a signal indicative of the state of the coupler, the signal being provided a sensor configured to provide the signal as the coupled state of the coupler has changed; transmitting the signal wirelessly to a controller;

processing the signal with a control algorithm resident upon the controller; and providing visually perceivable indication of the position of the coupler.

DETAILED DESCRIPTION OF EXEMPLARY EMBODIMENTS

Exemplary embodiments of the present invention are directed to a system and method for robust determination of a locomotive's coupler status. In general, yard engines or locomotives are dedicated to moving road locomotives or other rail cars (e.g., cars that are pushed or pulled by locomotives) to and from different service and staging areas of a rail yard. Accordingly, it is desirable to know when a yard engine is coupled to a rail car or road locomotive. In accordance with an exemplary embodiment, sensors are provided to determine both a coupled state and an uncoupled state of the locomotive. The sensor output is conveyed over a wireless network to a control and monitoring system. In one exemplary embodiment the coupler sensor data may be combined with other data such as speed and direction of motion of the locomotive, which can also be provided wirelessly. This information allows assessment and utilization of the locomotive. Furthermore, the coupler status can be used to monitor progress in completion of assigned tasks and planning of subsequent tasks, thereby increasing productivity of rail yard operations.

Reference is made to the following patent application Ser. No. 10/360,055, filed: Feb. 6, 2003, the contents of which are incorporated herein by reference thereto.

Figure 1:
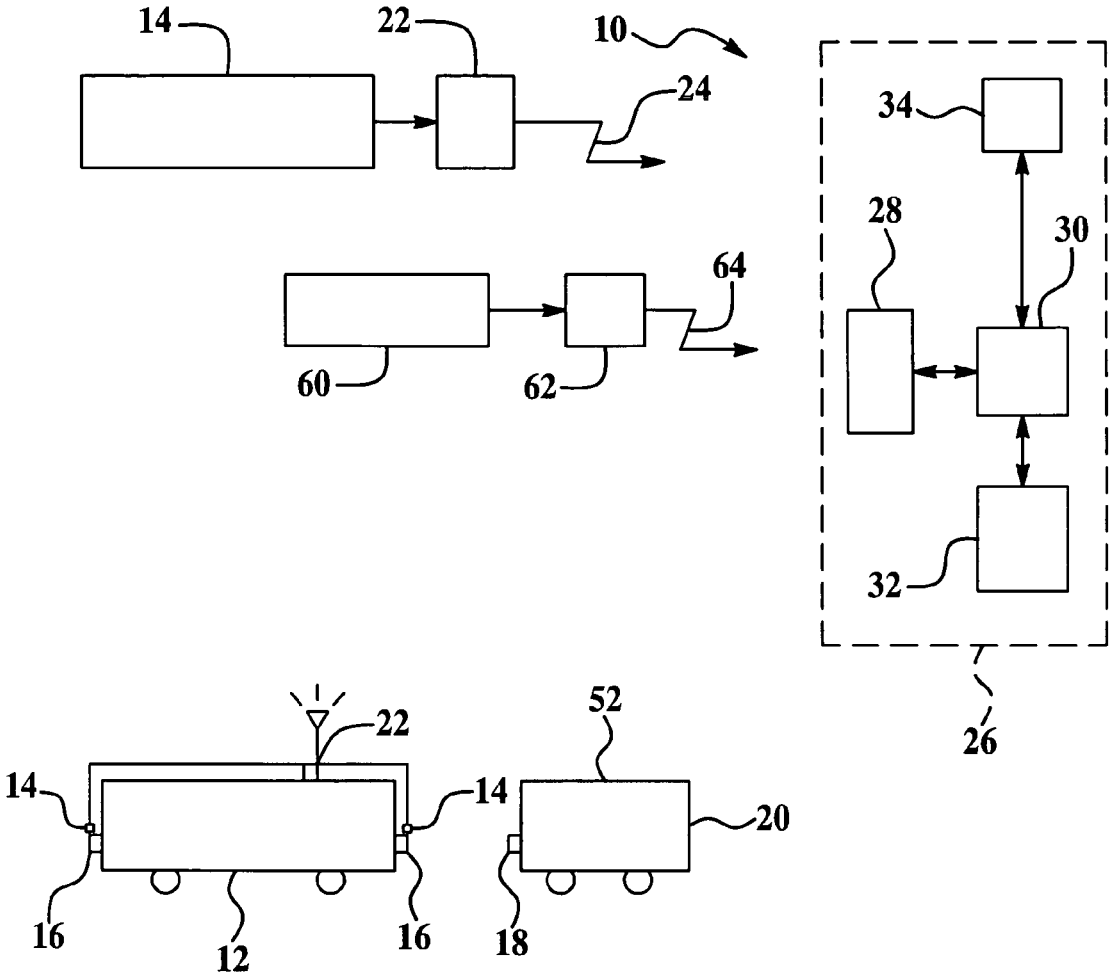
FIG. 1 is a schematic illustration of a monitoring system in accordance with exemplary embodiments of the present invention.
Figure 2:
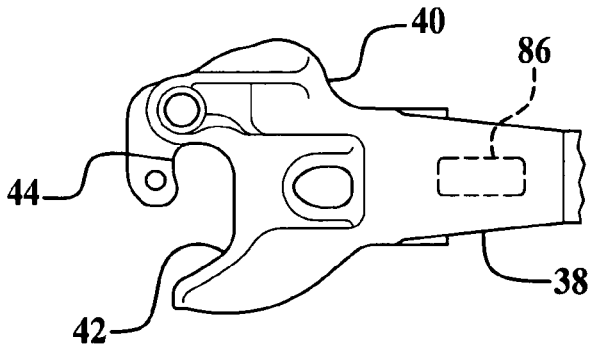
FIGS. 2-2B are views illustrating couplers constructed in accordance with exemplary embodiments of the present invention.
Figure 2A:
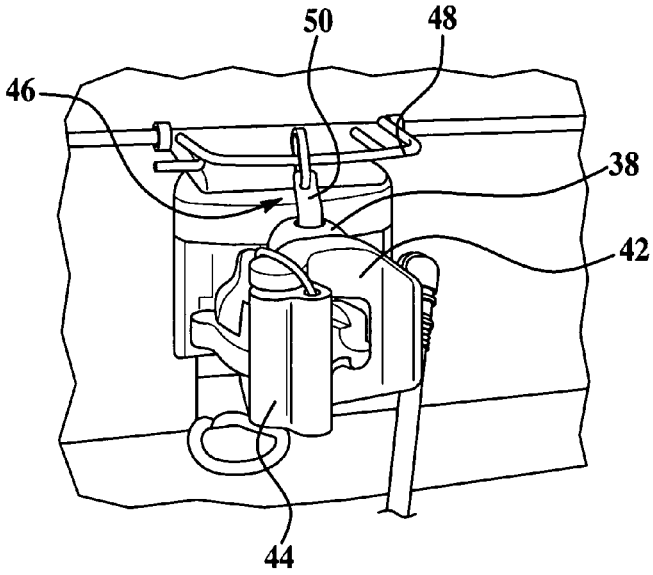

Referring now to FIGS. 1 and 2, a monitoring system 10 for use with a railroad locomotive 12 is illustrated. The control system utilizes a sensor or sensors 14 to determine whether a coupler 16 of a locomotive or engine 12 is coupled to another coupler 18 of a rail car 20. In an exemplary embodiment sensor 14 is in operable communication with a transceiver (e.g., receiver and transmitter) or a transmitter 22 configured to transmit a signal 24 indicative of the coupled state of coupler 16.

In addition, a status detection system 26 is provided wherein a receiver or transceiver 28 is in operable communication with a controller 30. Receiver or transceiver 28 is configured to receive signal 24 and provide the same to controller 30 wherein controller 30 is configured to analyze one or more input signals from sensors 14 and to produce one or more appropriate output signals for use in yard management. The controller may be in the form of a microcomputer, microcontroller, or other programmable control device as either a separate component or integral part of a rail yard operating system. As such, the controller may be any known type of analog or digital device, and it may be embodied as hardware, software or firmware.

The status detection system further includes a storage media 32 such as nonvolatile memory to store the control program instructions for the controller and other data used by system 10. Furthermore, the status detection system includes a display device 34 such as a computer monitor or screen to indicate train location and movements on a graphical representation of the rail yard, wherein and in an alternative exemplary embodiment the graphical display will include train locations, track locations and other features of the rail yard being monitored by the system.

In addition, the act of "coupling" or the use of "coupling" herein includes a completed connection and/or the contacting of coupler devices of train engines and rail cars as they interact to make up a coupling connection. In order to couple rail cars and locomotives (or engines) a coupler is disposed on at least one end of the same. There are several types of couplers known to those skilled in the related arts one such source of the types of couplers found are described in "The Railroad What It Is, What It Does" by John H. Armstrong, 4th Edition, Simmons-Boardman Books Inc., 1998, page 106).

Figure 2B:
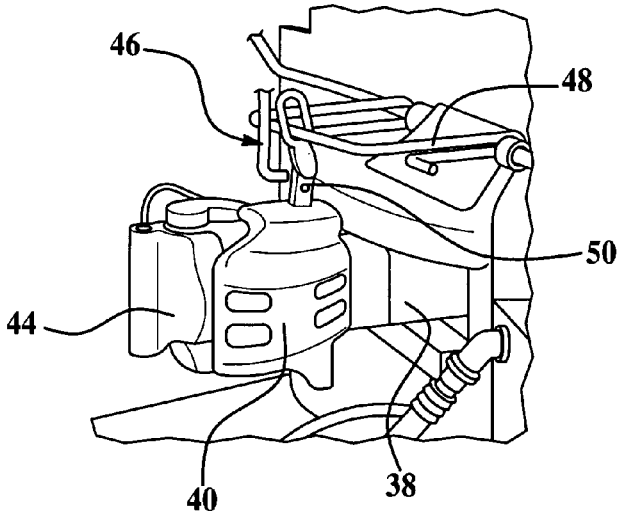

FIGS. 2-2B illustrates a non-limiting example of a coupler device (16, 18) contemplated for use in exemplary embodiments of the present invention. Each coupler device comprises a neck portion 38 having a clasping portion or head portion 40 secured thereto. Clasping portion 40 defines a throat portion or receiving area 42 configured to receive a portion of another coupling device secured thereto. The coupler also comprises a knuckle portion 44 pivotally mounted to a portion of the clasping portion defining the throat portion. Knuckle portion 44 is configured for pivotal movement between a coupled portion and an un-coupled portion in order to clasp another knuckle portion of another coupler therein.

Figure 3:
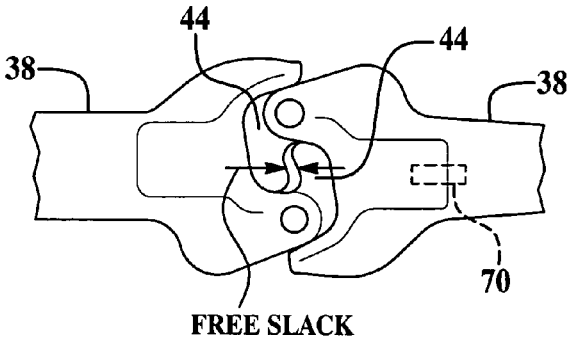
FIG. 3 is a top plan view of a pair of couplers in a coupled state.

In North America, the rail industry has standardized the use of a swinging knuckle design, which employs the principle of clasped hands. In order to automatically couple the couplers together, one or both of the knuckles must be open when the rail cars with the couplers are pushed together, wherein an open knuckle is moved (pushed) into a closed position by the second coupler device and a locking device 46 drops downward to keep the knuckle in this position and hold it closed. To uncouple the couplers, the cars are pushed together such that the load is removed from the coupler and an uncoupling lever 48 of the locking device is raised by an operator, who lifts a lock pin 50, which allows the knuckle to swing open as the car and engine are pulled apart. An illustration of two couplers coupled together is shown in FIG. 3.

Conditions incident to coupling include approaching railcar 20 (FIG. 1) (the approach), actual contact with the railcar (the impact) and the various resulting effects of the impact (the effect). Information representative of these conditions can be identified, recorded and provided to monitoring system 10 through various sensors 14. In addition, the act of "coupling" as that term is used in this herein includes a completed connection and/or the contacting of the coupler devices as they interact to make up the coupling connection, as appropriate for the context of the description.

In addition and as used herein, "uncoupling" is defined as the absence of a connection between coupler devices or the opening and separation of coupler devices. It must be noted that uncoupling does not involve an impact as results from the coupling event (when locomotive is brought into contact with the rail car at speeds typically less than four miles per hour).

In accordance with an exemplary embodiment, sensors 14 are installed on couplers at each end (forward and rear) of a locomotive (or yard engine). The output of these sensors is conveyed using wireless network from the locomotive to a central control location (i.e. monitoring location) wherein the status detection system is located. In addition to the coupler sensors, the speed and direction of motion of the locomotive may also be conveyed to the central control location. Speed and direction may be obtained using GPS receiver or other devices 60 also equipped with a transceiver or transmitter 62 to at least transmit a speed and direction signal 64 to the transceiver of the status detection system.

In accordance with exemplary embodiments of the present invention the sensing of the couplers is implemented using one or more of the following approaches: proximity sensors embedded within the knuckle or throat of the coupler device; one or more strain gauge sensors affixed to the coupler neck; a magnetic circuit; and a visual detection system comprising a camera and computer vision system or any other equivalent device capable of providing a real-time signal or signals indicative of coupler status.

Referring now to FIG. 3, an exemplary embodiment comprising one or more inductive proximity sensors 70 embedded within the knuckle or throat of the coupler device is illustrated. Here an industrial proximity sensor is located in the coupler body with its active end at the throat wherein the presence of a knuckle on another coupler in the throat triggers the sensor or causes the sensor to provide an output signal. Such inductive proximity sensors are commonly used within industrial environments to detect presence of ferrous metals. One non-limiting example of such an inductive proximity sensor is available from Turck, wherein additional information is found at www.turck.com. Of course, other inductive sensors are contemplated for use with exemplary embodiments of the present invention. Accordingly, such a sensor will respond to the presence of another steel knuckle in close proximity to the sensor. In accordance with an exemplary embodiment and referring now to FIGS. 4 and 5, multiple sensors 70 are used to detect a coupled or uncoupled state regardless of the direction of motion (i.e. pushing or pulling of the rail car).

Figure 4:
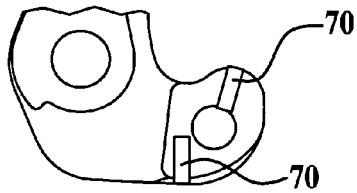
FIG. 4 is a view of a sensing device in accordance with an exemplary embodiment of the present invention.

FIG. 4 shows a non-limiting example as to where a pair of proximity sensors 70 would be installed within a knuckle, each sensor having their active end disposed to detect a portion of another knuckle. While the proximity sensors could be installed in the coupler neck or throat, installation of these sensors in the knuckle affords rapid configuration and utilization as knuckles can be changed by Carmen in a matter of minutes. Change of a coupler neck, on the other hand, requires service within a locomotive shop.

Figure 5:
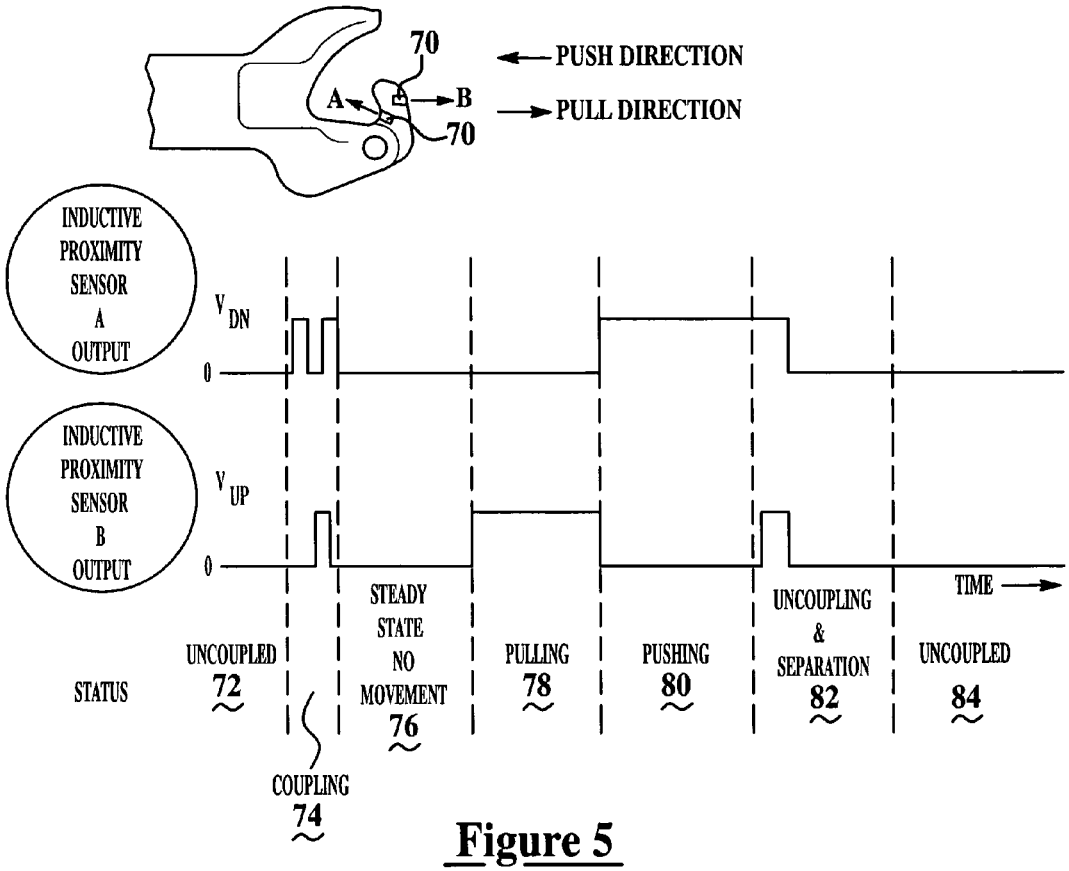
FIG. 5 is a graphical representation of output signals of a pair of sensors in accordance with an exemplary embodiment of the present invention.

Referring now to FIG. 5, a graph of the sensors A and B are shown for signals of various coupling states. In the absence of a proximate metal, the proximity sensors will output a low (zero) voltage level (state 72). Using the configuration of FIG. 4, one or both proximity sensors will provide a high voltage level when another knuckle and coupler are brought in contact during a coupling event. Depending upon the relative position of the two couplers and their knuckles, open space referred to as "slack", may place the coupler components beyond the sensor detection range. Under such a condition the sensors will not detect the coupled state. This is illustrated as state 76. As the railcar is moved, one or more of the proximity sensors will provide the high voltage output regardless of the direction of the movement (i.e. push or pull of the rail car). This is illustrated as states 78 and 80. Uncoupling and separation is also illustrated as state 82 wherein both sensors will provide an output. The location of the proximity sensors is selected to accommodate potential misalignment of the couplers, which is on the order of 10 degrees or less. Misalignment is shown as "free slack" in FIG. 3. Furthermore, the proximity sensors are selected to provide a detection distance for the metal surfaces on the order of ⅜ inch (which represents half of the ¾ inch cited as slack spacing for a pair of couplers in a nominal condition). Of course, other configurations are contemplated in accordance with exemplary embodiments of the present invention.

Referring back now to FIG. 5, wherein proximity sensor outputs for various coupling conditions and car movements is provided it is noted that during steady state the output levels from the sensors depends upon the resulting slack and detection distances of the proximity sensors. In accordance with an exemplary embodiment, both coupling and uncoupling events appear on one or both sensor outputs (state 74 and 82). Thus, and as the locomotive moves, at least one of the proximity sensors is brought into contact or near contact with the opposite knuckle or coupler as the slack is pulled out from the cars. Accordingly, this output and data as provided to the controller wherein further processing is provided and the status of the yard engine or locomotive is provided to the yard operator.

Figure 6:
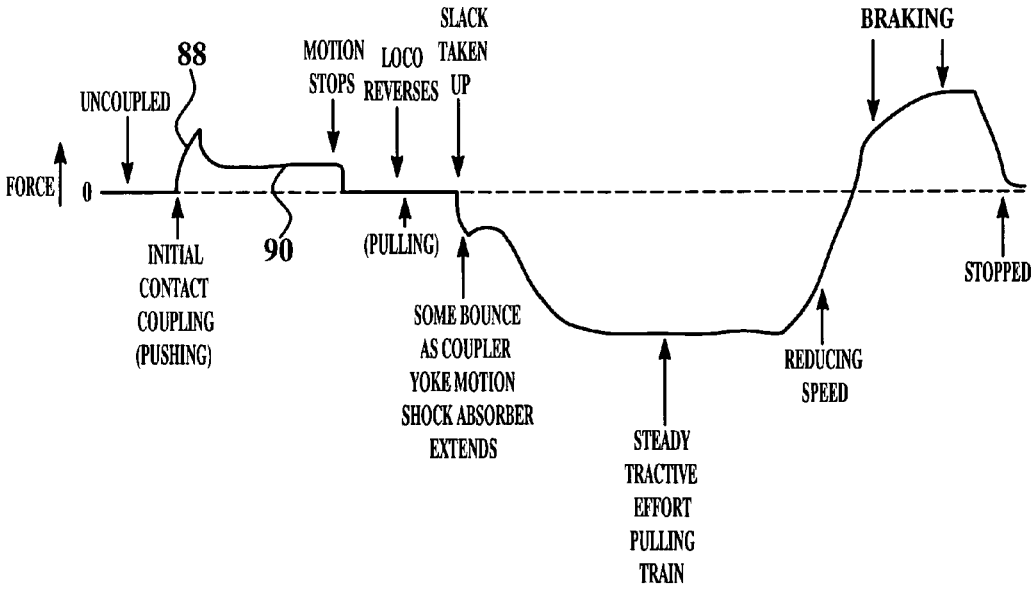
FIG. 6 is a graphical representation of output signals in accordance with an alternative exemplary embodiment of the present invention.

In an alternative embodiment and referring now to FIGS. 1, 2 and 6, one or more strain gauge sensors 86 are affixed to the coupler neck. In this embodiment, the force on the neck is detected by the sensor, which will indicate whether a load is either being pushed or pulled by the locomotive. A non-limiting example of the output from a strain gauge 86 installed on the coupler neck is illustrated in FIG. 6. As shown, the force from the coupling event translates to a positive output signal 88 from the sensor. As the locomotive pushes or pulls the rail car (or another locomotive), the forces produce non-zero output from the strain gauge. Thereafter, FIG. 6 illustrates locomotive stoppage, locomotive reversing, bounce from pulling, and steady pulling by the engine. Thereafter, sensor outputs corresponding to reduced speed, breaking and stopped train conditions are also illustrated. Accordingly, each of these conditions are capable of being sensed by the strain gauge sensor or sensors (in any type of order) wherein a sensor provides an output signal in digital or analog format for further interpretation by control algorithms of system 10.

In this embodiment, detection of an uncoupling event will also require combination of engine motion (i.e. speed) information from sensor 60. In other words, the uncoupling event will be recognized only when the locomotive moves and the speed signal will be the second signal required to show that the locomotive is moving and uncoupled. Non-limiting examples of a strain gauges sensor comprise a Wheatstone bridge and the output voltage is recorded using a V-Link wireless data recorder by MicroStrain.

Figure 7:
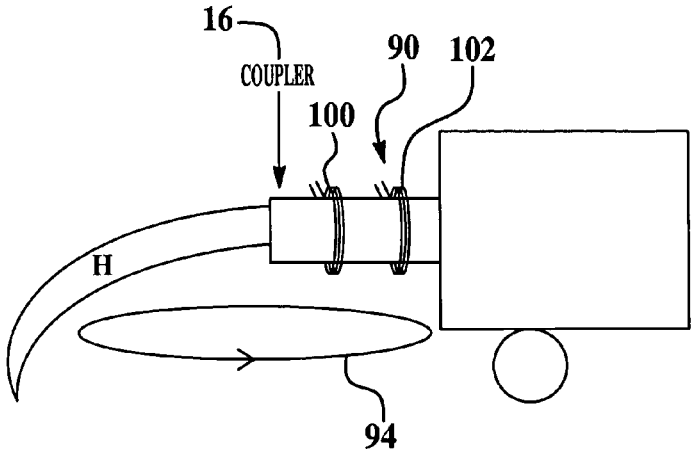
FIGS. 7-9 are illustrations of an alternative exemplary embodiment.
Figure 8:
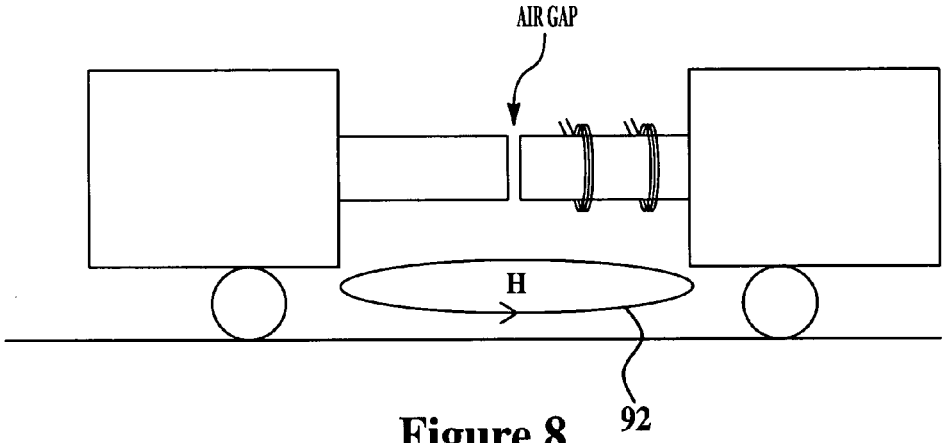
Figure 9:
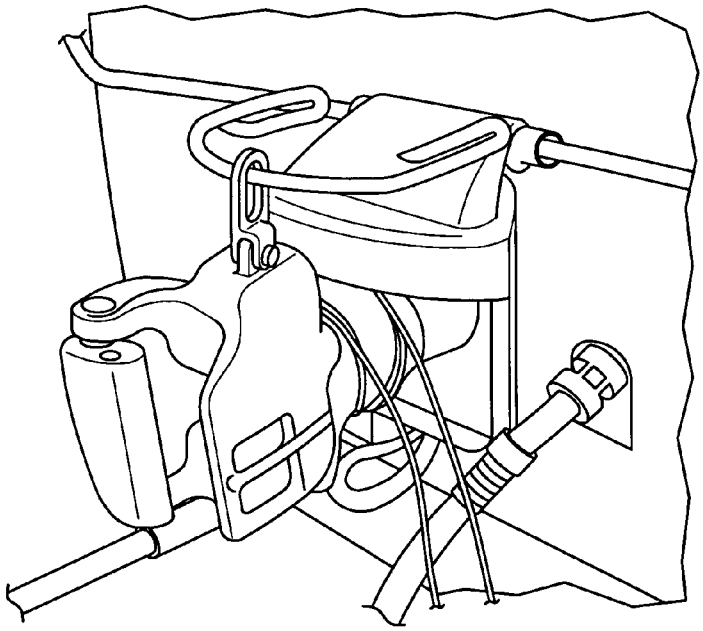

Referring now to FIGS. 7-9, another alternative exemplary embodiment is illustrated. Here a magnetic signaling device 90 is illustrated. In this embodiment and when the locomotive is coupled to the car, there is a magnetic circuit of high average permeability 94 that is defined by a closed path that runs from the neck of one coupler through the adjacent coupler, through the adjacent car frame, and returns through the rail to the other car frame, and back to the point of origin on the original coupler's neck. An effective air gap between the two couplers subsumes such small distances as non-ferromagnetic iron oxide patina, oil interfaces, etc. When the locomotive and the car are decoupled (FIG. 7), the air gap portion of the magnetic circuit is significantly increased, as the flux must then pass through the air from the coupler tip to the rails. This is illustrated as magnetic circuit 94. In this embodiment the magnetic sensing device comprises a means for differentiating between the coupled and uncoupled states by sensing the change in average permeability of the magnetic circuit.

As a very crude analysis: the inductance seen by the magnetic circuit is proportional to the relative permeability, $\mu_e$, of the magnetic material in the circuit where $\mu_e$ is defined as $\mu_e=\mu/\mu_0$. $\mu$ is the permeability (or "absolute permeability") of the material within the magnetic circuit, in this case iron. With the air gap, $\mu_e=\mu_r/(1+(\mu_r l_g/l_e))$, where $\mu_r$ is the relative permeability of the iron, and $l_g$ is the length of the gap.

Consider that in the locomotive-car separated case, an air gap of length $l_g$ in the magnetic circuit is approximated by the effective length of flux line travel. In this case, $\mu_e \approx \mu_r/(1+\mu_r) \approx 1$. If the locomotive is in contact with the car, locomotive-car contact case, we approximate $l_g \approx 0$ and $\mu_e \approx \mu_r$. The change in inductance between the locomotive-car separated case and the locomotive-car contact case should be dramatic and this change should be detectable in a number of ways.

One way of providing this sensing device is illustrated in FIGS. 7-9, wherein the drawbar is surrounded with two electrical coils 100 and 102 at different locations. A time-varying current is passed through one coil that establishes a time-varying magnetic field. The time-varying magnetic field induces a current in the second coil. The magnitude of the induced current will be greater for the coupled state. Thus, the coupled state will be detected.

An alternative method for sensing the change in inductance of the magnetic circuit is to use a single coil as part of an inductance estimating circuit such, as a simple tuned-circuit resonator.

Figure 10:
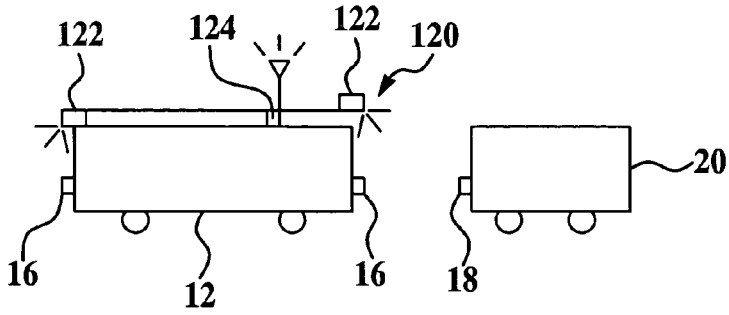
FIG. 10 is a schematic illustration of yet another alternative exemplary embodiment.

Referring now to FIG. 10 yet another alternative exemplary embodiment is illustrated. Here a visual sensing system 120 with remote sensing capabilities is provided. In this embodiment, a camera 122 is mounted on the end of the locomotive, above and oriented at the coupler. The camera is coupled to a transceiver 124 wherein video signals are provided to computer vision algorithms resident upon the microprocessor of the status detection system, wherein the vision algorithms are applied to the incoming video stream to detect a coupled state or uncoupled state. The image and computer processing algorithms such as pattern matching, edge detection and other techniques can be applied to discern the two states. The video camera may also include an infrared illumination source to provide enhanced operation during night and inclement weather conditions.

In accordance with an embodiment of the present invention a robust sensor for detecting coupled and uncoupled status of a locomotive or yard engine is provided. As disclosed herein and in accordance with an exemplary embodiment, wireless communication of the sensor state is provided from the locomotive to a control (monitoring) location.

In addition, the coupling detection of yard engines can be used by yard personnel to plan and assign yard tasks as these inputs can also be used to feed an automated monitoring system which captures historical performance data as to task completion for individual locomotives and their operators. Moreover, such an automated monitoring system can also be used by yard personnel to enhance their planning and overall yard productivity.

Figure 11:
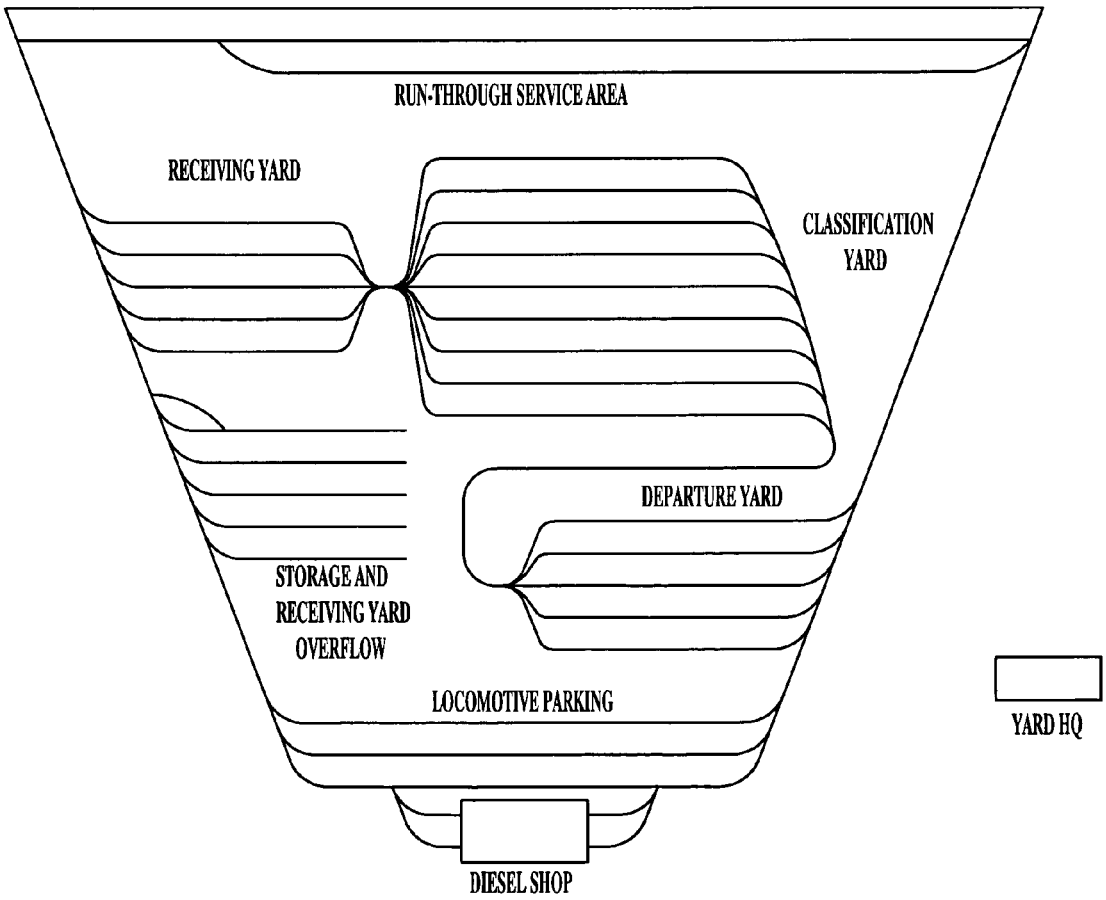
FIG. 11 is a schematic illustration of a rail yard.

Accordingly, exemplary embodiments of the present invention allow for fast, simple and low cost methods of creating an accurate track location database for a rail yard. A generic view of a rail yard is illustrated in FIG. 11.

In accordance with an exemplary embodiment, the monitoring system comprises at least a central computer, a rail track database and sensors to provide real time data of rail yard assets for use with the rail track database to provide a visual representation of the assets as they move through the rail yard, which may include various sub yards including but not limited to a receiving yard, a classification yard, a storage and receiving yard, and a departure yard. In accordance with an exemplary embodiment, the present invention employs GPS receivers to provide accurate track placement of locomotives on a status display. Exemplary embodiments provide real-time location of rail yard assets to rail yard personnel in order to enable time-critical decisions to be made relative to task planning, safety and efficiency.

As described above, algorithms for implementing exemplary embodiments of the present invention can be embodied in the form of computer-implemented processes and apparatuses for practicing those processes. The algorithms can also be embodied in the form of computer program code containing instructions embodied in tangible media, such as floppy diskettes, CD-ROMs, hard drives, or any other computer-readable storage medium, wherein, when the computer program code is loaded into and executed by a computer and/or controller, the computer becomes an apparatus for practicing the invention. Existing systems having reprogrammable storage (e.g., flash memory) that can be updated to implement various aspects of command code, the algorithms can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer. When implemented on a general-purpose microprocessor, the computer program code segments configure the microprocessor to create specific logic circuits.

These instructions may reside, for example, in RAM of the computer or controller. Alternatively, the instructions may be contained on a data storage device with a computer readable medium, such as a computer diskette. Or, the instructions may be stored on a magnetic tape, conventional hard disk drive, electronic read-only memory, optical storage device, or other appropriate data storage device. In an illustrative embodiment of the invention, the computer-executable instructions may be lines of compiled C++ compatible code.

In accordance with exemplary embodiments of the present invention the central control unit may be of any type of controller and/or equivalent device comprising among other elements a microprocessor, read only memory in the form of an electronic storage medium for executable programs or algorithms and calibration values or constants, random access memory and data buses for allowing the necessary communications (e.g., input, output and within the microprocessor) in accordance with known technologies. It is understood that the processing of the above description may be implemented by a controller operating in response to a computer program. In order to perform the prescribed functions and desired processing, as well as the computations therefore, the controller may include, but not be limited to, a processor(s), computer (s), memory, storage, register(s), timing, interrupt(s), communication interfaces, and input/output signal interfaces, as well as combinations comprising at least one of the foregoing.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for indicating whether a first coupler of a locomotive is in a coupled or an uncoupled state, the apparatus comprising:

a sensor positioned on a portion of the coupler, wherein the sensor provides a real-time signal indicative of either a coupled state or an uncoupled state, the coupled or uncoupled state indicating a proximity or presence of a portion of a second coupler within a receiving area of the first coupler, wherein the sensor comprises a magnetic circuit configured to provide a detectable permeability when the first coupler is proximate to or coupled to the second coupler, and wherein the magnetic circuit is provided by a pair of coils located in a facing space relationship on the first coupler and the apparatus further comprises a sensor for detecting an induced current greater than a predetermined value through the pair of coils, the induced current being generated when the first coupler is secured to the second coupler.

2. The apparatus as in claim 1, wherein the sensor is an inductive proximity sensor configured to detect the presence of the second coupler proximate to a throat of the first coupler.

3. The apparatus as in claim 1, wherein the signal is transmitted wirelessly by a transmitter in operable communication with the sensor.

4. A coupler configured to indicate whether the coupler is coupled to another rail car, the coupler comprising:

a main body portion comprising a neck portion and a receiving area defined by a portion of the main body portion;

a knuckle pivotally mounted to the main body portion and configured for movement between a coupled position and an uncoupled position wherein the knuckle pivots into the receiving area as the knuckle pivots from the uncoupled position to the coupled position; and a sensor positioned on a portion of the coupler, wherein the sensor provides a signal indicative of either a coupled or an uncoupled state, the coupled or uncoupled state dependent upon the presence or proximity of a portion of a second coupler within the receiving area, wherein the sensor comprises a magnetic circuit configured to provide a detectable permeability when the coupler is coupled to another rail car, and wherein the magnetic circuit is provided by a pair of coils located in a facing space relationship on the coupler and the coupler further comprises a sensor for detecting an induced current greater than a predetermined value through the pair of coils, the induced current being generated when the coupler is coupled to the another rail car.

5. The coupler as in claim 4, wherein the sensor is an inductive proximity sensor configured to detect the presence of another coupler proximate to a throat or the knuckle of the coupler the sensor is positioned on.

6. The coupler as in claim 4, wherein the signal is transmitted wirelessly by a transmitter in operable communication with the sensor.

7. A method for determining whether a coupler of a locomotive engine is coupled, the method comprising:

providing a signal indicative of either a coupled or uncoupled state of the coupler;

transmitting the signal wirelessly to a controller;

processing the signal with a control algorithm resident upon the controller;

providing visually perceivable indication of the coupled or uncoupled state of the coupler, configuring a video camera to provide video signals to the controller; and programming the controller with image processing algorithms for determining whether the video signals depict a coupled or uncoupled locomotive.

8. The method as in claim 7, further comprising:

disposing a pair of inductive proximity sensors on a knuckle of the coupler;

configuring a first one of the pair of inductive proximity sensors to provide a first signal indicating that the coupler is pulling another coupler; and configuring a second one of the pair of inductive proximity sensors to provide a second signal indicating that the coupler is pushing another coupler.

9. The method as in claim 7, further comprising:

positioning a strain sensor on a neck of the coupler; and configuring the strain sensor to provide nonzero voltage output signals when either a pushing or pulling force is applied to the coupler.

10. The method as in claim 7, further comprising configuring a magnetic circuit to provide a detectable permeability when the coupler is coupled to another coupler.

11. A system for detecting whether a coupler of a locomotive has been coupled to another rail car, the system comprising:

a sensing device configured to provide a signal indicative of a coupling state of the coupler;

a transmitter in operable communication with the sensing device, the transmitter being configured to receive and transmit the signal;

a status detection system configured to receive the signal from the transmitter, the status detection system comprising:

a controller; and a storage medium; and wherein the sensing device is a video camera configured to provide video signals to the controller, wherein the controller further comprises image processing algorithms for determining whether the video signals depict a coupled or uncoupled locomotive.

* * * * *

UNITED STATES PATENT AND TRADEMARK OFFICE

CERTIFICATE OF CORRECTION

PATENT NO. : 7,845,504 B2
APPLICATION NO. : 11/317067
DATED : December 7, 2010
INVENTOR(S) : Davenport et al.

It is certified that error appears in the above-identified patent and that said Letters Patent is hereby corrected as shown below:

In Column 7, Line 50, delete “embodiment” and insert -- exemplary embodiment --, therefor.

Signed and Sealed this
Fourteenth Day of June, 2011

David J. Kappos

David J. Kappos
*Director of the United States Patent and Trademark Office*